US005826730A

United States Patent [19]

Stravitz

[11] Patent Number: 5,826,730

[45] Date of Patent: Oct. 27, 1998

[54] FILE FOLDER ORGANIZER

[76] Inventor: David M. Stravitz, 16 Park Ave. Suite 14A, New York, N.Y. 10016

[21] Appl. No.: 746,218

[22] Filed: Nov. 7, 1996

[51] Int. Cl.[6] ..... A47F 1/04

[52] U.S. Cl. ..... 211/55; 108/92

[58] Field of Search ..... 211/50, 10, 11, 211/55, 52; 108/24, 91, 92

[56] References Cited

U.S. PATENT DOCUMENTS

| | | | |
|---|---|---|---|
| 1,035,553 | 8/1912 | Doering, Sr. | 211/55 |
| 1,594,754 | 8/1926 | Reines | 211/55 X |
| 1,595,437 | 8/1926 | Webster | 211/55 X |
| 1,745,164 | 1/1930 | Griffith | 211/55 X |
| 1,903,936 | 4/1933 | Nunnery | 211/55 X |
| 2,522,483 | 9/1950 | Plack | 211/11 X |
| 3,210,865 | 10/1965 | Muntz | 211/55 X |
| 3,233,744 | 2/1966 | Ripps | 108/24 X |
| 4,285,558 | 8/1981 | Medford | 211/55 X |
| 4,955,677 | 9/1990 | Song | 211/55 X |
| 5,575,396 | 11/1996 | Smed | 211/55 X |

FOREIGN PATENT DOCUMENTS

| | | | |
|---|---|---|---|
| 2345934 | 3/1975 | Germany | 211/55 |

OTHER PUBLICATIONS

Newell Office Products Company catalog, effective Jul. 1, 1996, Stationery Caddies shown on pp. 25 and 39, Newell Office Products Company, Madison. Wisconsin, USA.

*Primary Examiner*—Jose V. Chen

*Attorney, Agent, or Firm*—Frishauf, Holtz, Goodman, Langer & Chick

[57] ABSTRACT

A file folder organizer includes a front wall having a lower edge and an upper edge; a rear wall having a lower edge and an upper edge; and side walls connecting the front and rear walls together in parallel, spaced apart relation such that the lower edge of the rear wall is raised relative to the lower edge of the front wall and the upper edge of the rear wall is raised relative to the upper edge of the front wall, and lower edges of the side walls and the lower edges of the front wall are substantially coplanar to support the file folder organizer on a horizontal surface in a vertical orientation thereof. A bottom wall connects the lower edge of the front wall to the lower edge of the rear wall, the bottom wall having a plurality of steps of different heights, the steps of the bottom wall being parallel and offset from each other in a heightwise direction of the organizer and in a depthwise direction of the organizer, the bottom wall being at least partially enclosed by the side walls so that the side walls hide the steps of the bottom wall. At least one lengthwise dividing wall divides an area bounded by the front wall, the rear wall and the side walls into a plurality of compartments, at least two of the compartments being closed at a bottom thereof by different steps of the bottom wall so as to provide a staggered relation to the compartments.

6 Claims, 6 Drawing Sheets

FILE FOLDER ORGANIZER

CROSS REFERENCE TO RELATED APPLICATION

The present application is related to my U.S. Design Pat. application Ser. No. 29/062,425, filed Nov. 4, 1996 (attorney docket number 960425DES/LH) directed to the same article as the present application, and the entire contents of which are incorporated hereby reference.

BACKGROUND OF THE INVENTION

This application relates to an organizer, and more particularly, is directed to an organizer for storing file folders and the like.

Organizers for storing and organizing file folders to be held on a desk or the like are well known. Specifically, organizers for storing and organizing file folders and other papers are know which include a one piece molded member having a plurality of vertically oriented compartments which receive the file folders.

Generally, these organizers can be grouped into three different groups.

A first group includes organizers having compartments of equal height, so that the file folders are stored one behind the other. However, with such organizers, it becomes difficult to view any labels provided on the rearmost file folders, and therefore, it becomes necessary to remove the file folders from the organizer in order to determine the subject matter of the rear file folders. This is because the label on one file folder will generally block the view of the label on an adjacent file folder.

A second group includes organizers having compartments which are of the same height but staggered in height relative to each other by means of steps. However, such organizers cannot support themselves on a desk because of the stepped arrangement. Therefore, such organizers are limited to being hung on walls.

A third group includes organizers having compartments of differing heights, thereby providing a staggered relation. There is no stepped relation. Rather, larger file folders and papers are placed in the larger, rear compartments and extend to a height higher than the shorter folders and papers in the forward compartments. However, if file folders of the same height are used, the file folders will be difficult to access from the rear compartments, and in addition, the same disadvantages of the first group of organizers would also apply.

SUMMARY OF THE INVENTION

An object of the present invention is to provide a file folder organizer which overcomes the aforementioned problems with the prior art.

It is another object of the present invention to provide a file folder organizer that provides a staggered relation to equal size file folders, and which can also sit on a desk.

It is still another object of the present invention to provide a file folder organizer in which the stepped arrangement for staggering is hidden from view by the support for the file folder organizer.

It is yet another object of the present invention to provide a file folder organizer which has good structural integrity.

It is a further object of the present invention to provide a file folder organizer which is attractive and practical in use.

In accordance with an aspect of the present invention, a file folder organizer includes a front wall having a lower edge and an upper edge; a rear wall having a lower edge and an upper edge; side walls connecting the front wall and the rear wall together in parallel, spaced apart relation such that the lower edge of the rear wall is raised relative to the lower edge of the front wall and the upper edge of the rear wall is raised relative to the upper edge of the front wall, and lower edges of the side walls and the lower edges of the front wall are substantially coplanar so as to support the file folder organizer on a horizontal surface in a vertical orientation thereof; a bottom wall connecting the lower edge of the front wall to the lower edge of the rear wall, the bottom wall having a plurality of steps of different heights, the bottom wall being at least partially enclosed by the side walls so that the side walls hide the steps of the bottom wall; and at least one dividing wall for dividing an area bounded by the front wall, the rear wall and the side walls into a plurality of compartments, at least two of the compartments being closed at a bottom thereof by different steps of the bottom wall so as to provide a staggered relation to the compartments.

The steps of the bottom wall are parallel and are offset from each other in a heightwise direction of the organizer and in a depthwise direction of the organizer.

Further, the at least one dividing wall includes at least one lengthwise wall parallel to the front and rear walls and positioned therebetween. At least one transverse wall may be provided perpendicular to the at least one lengthwise wall and extending between the at least one lengthwise wall and at least one of the front wall and the rear wall.

In addition, a plurality of ribs are preferably provided on the bottom wall and at least one rib is provided on each side wall.

Also mold positioning and retaining holes, which also serve as drain holes, are preferably provided in the bottom wall.

The above and other objects, features and advantages of the invention will become readily apparent from the following detailed description thereof which is to be read in connection with the accompanying drawings.

DETAILED DESCRIPTION

Figure 1:
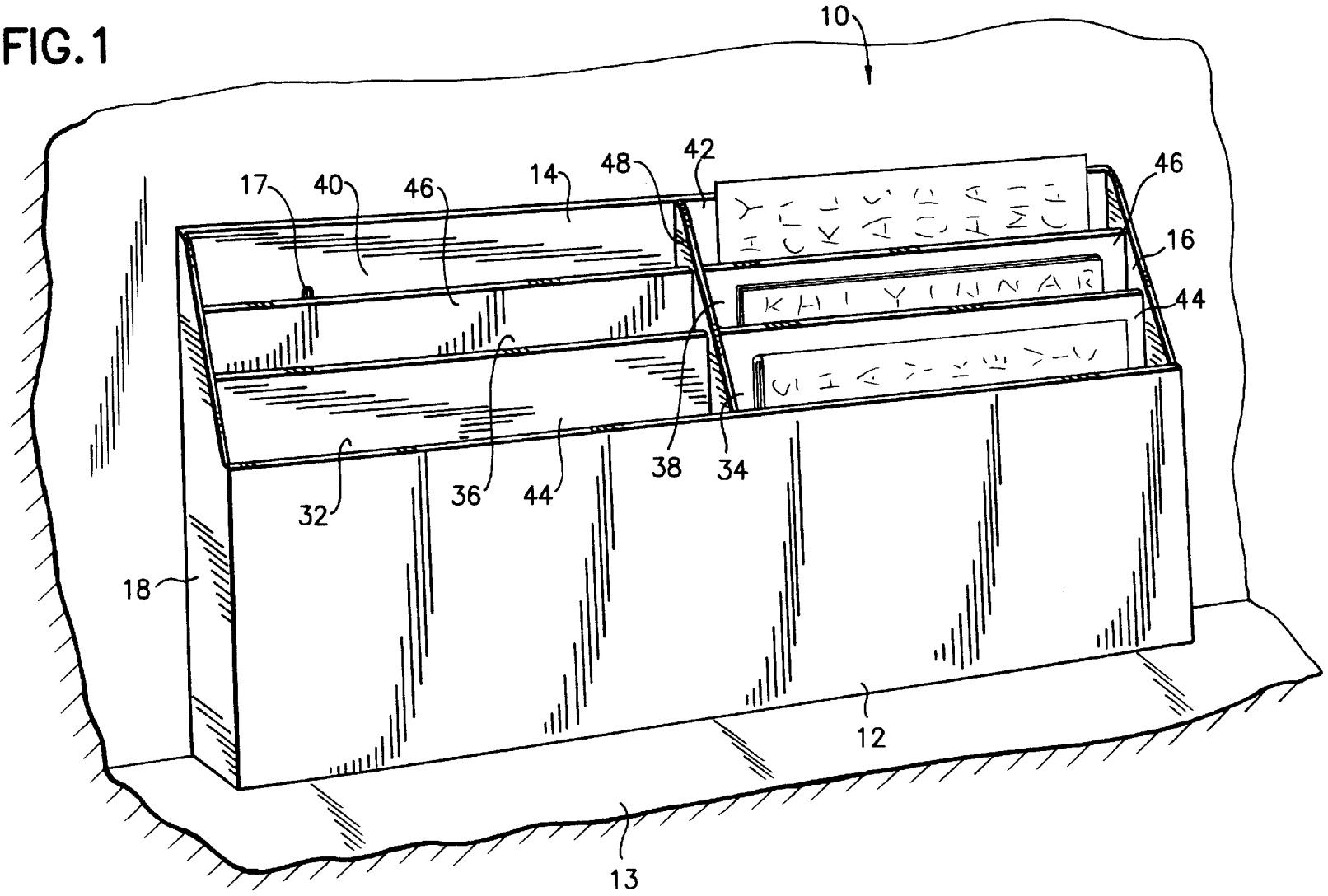
FIG. 1 is a perspective view of a file folder organizer according to the present invention, shown in a vertical position, resting on a horizontal surface, such as a desk or table top, and placed against a wall.

Referring to the drawings in detail, a file folder organizer 10 according to the present invention includes a rectangular front wall 12, a staggered or raised rectangular rear wall 14 and two side walls 16 and 18 which connect front wall 12 and rear wall 14 together in parallel, spaced apart relation. In regard to the staggered relation of front wall 12 and rear wall 14, the lower edge of front wall 12 rests on a desktop 13 when organizer 10 is vertically oriented on the desktop, as shown in FIG. 1, while rear wall 14 has its lower edge raised by, for example, about 3 inches, relative to the lower edge of front wall 12, and its upper edge also raised relative to the upper edge of front wall 12.

Side walls 16 and 18 have lower edges which are coplanar with the lower edge of front wall 12, so that the lower edges of side walls 16 and 18 rest on desktop 13 when organizer 10 is vertically oriented on the desktop, as shown in FIG. 1, whereby organizer 10 is stably supported by front wall 12 and side walls 16 and 18. FIG. 1 shows organizer 10 with its rear wall 14 against a vertical surface such as a wall. This gives further stability, but organizer 10 can be stably used in a free standing position, without placing same against a vertical wall or other vertical surface.

Figure 5:
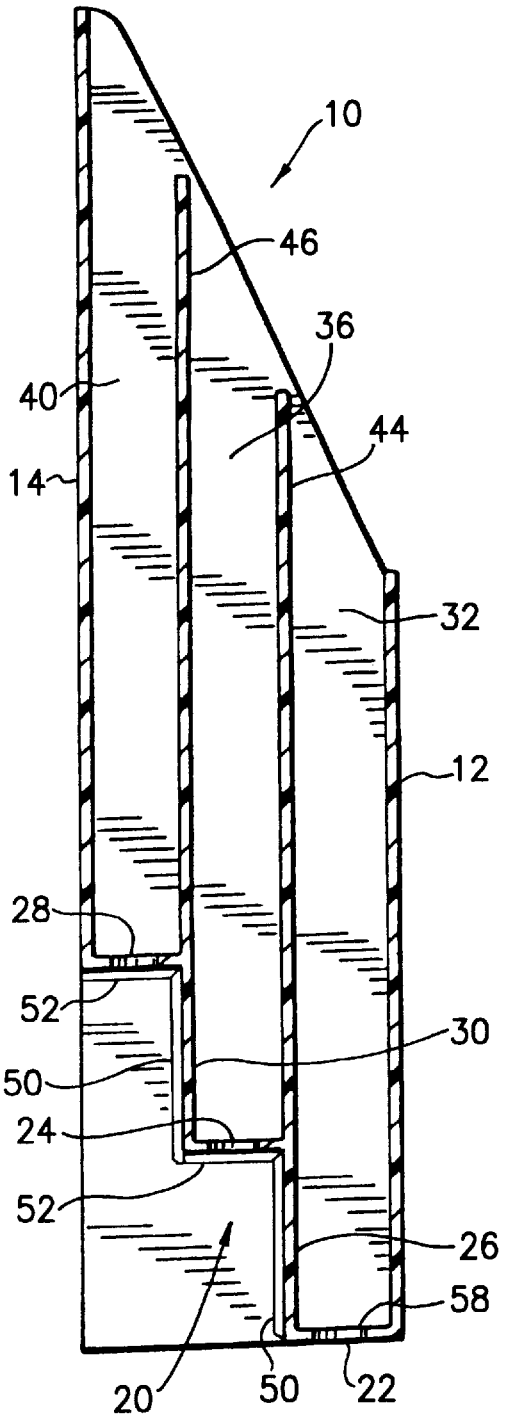
FIG. 5 is a sectional view taken along line 5—5 in FIG. 4.
Figure 8:
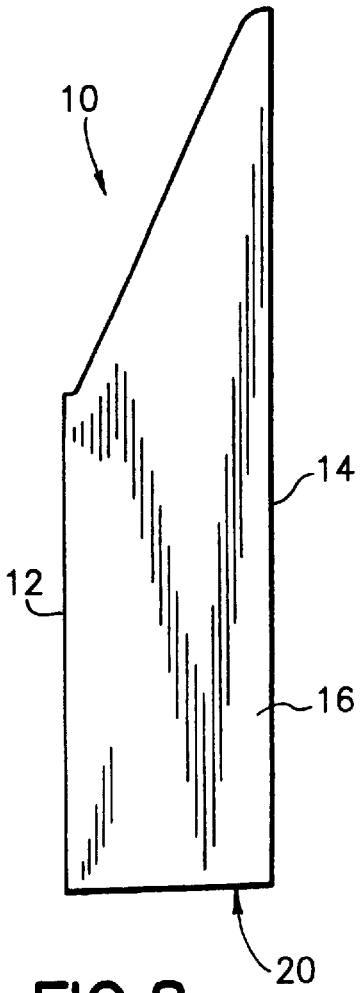
FIG. 8 is a right side elevational view thereof with the organize in the vertical position, the left side elevational view being a mirror image thereof.
Figure 7:
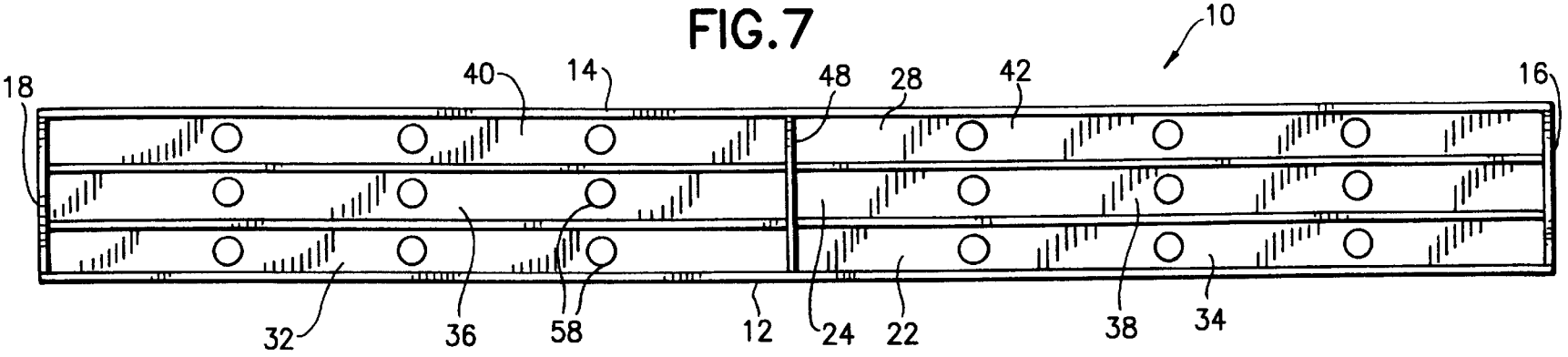
FIG. 7 is a top plan view thereof.
Figure 6:
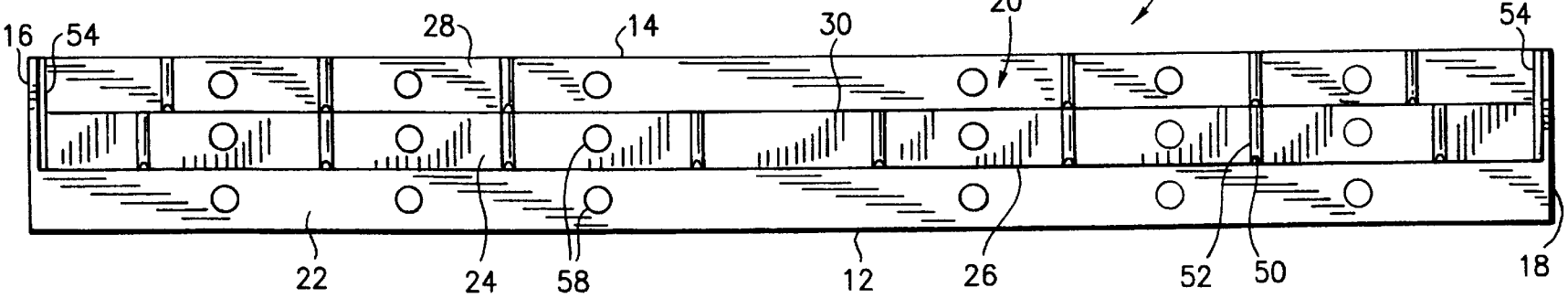
FIG. 6 is a bottom plan view thereof.

Organizer 10 further includes a bottom wall 20 which is stepped (see FIG. 5). Specifically, as seen in FIGS. 5–7, bottom wall 20 includes a first rectangular bottom panel 22 that is coplanar with the lower edge of front wall 12, so that first bottom panel 22 rests on desktop 13 when organizer 10 is vertically oriented on desktop 13, as shown in FIG. 1, whereby organizer 10 is further supported by first bottom panel 22.

Organizer 10 also includes a second rectangular bottom panel 24 which is raised relative to first bottom panel 22 and which is rearwardly offset from first bottom panel 22. Second bottom panel 24 is parallel to first bottom panel 22. The rear edge of first bottom panel 22 is connected to the front edge of second bottom panel 24 by means of a first rear closure panel 26 which is parallel to rear wall 14 but offset forwardly therefrom.

Organizer 10 further includes a third rectangular bottom panel 28 which is raised relative to second bottom panel 24 and which is rearwardly offset from second bottom panel 24. Third bottom panel 28 is parallel to first and second bottom panels 22 and 24. The rear edge of second bottom panel 24 is connected to the front edge of third bottom panel 28 by means of a second rear closure panel 30 which is parallel to rear wall 14, and which is positioned between rear wall 14 and first rear closure panel 26.

The area between front and rear walls 12 and 14 is divided into compartments 32, 34, 36, 38, 40 and 42 by dividing walls. Specifically, two parallel, spaced apart widthwise dividing walls 44 and 46 extend between front and rear walls 12 and 14 and in parallel relation thereto. Further, widthwise dividing walls 44 and 46 are divided in half by a transverse dividing wall 48 (see FIGS. 1–3 and 7) that extends from front wall 12 to rear wall 14.

The separation between dividing walls 44 and 46 and front and rear walls 12 and 14 corresponds to the depth of bottom panels 22, 24 and 28, so that bottom panels 22, 24 and 28 define the bottom walls of compartments 32–42.

With this arrangement, because of the offset of front and rear walls 12 and 14, and because of the staggered relation of bottom panels 22, 24 and 28, compartments 32–42 are staggered in height. However, the absolute height of each compartment is the same, so that equal size file folders placed in the compartments will be staggered vertically (as shown in FIG. 1) for easy viewing and accessibility. At the same time, however, due to side walls 16 and 18, organizer 10 can sit on its own (i.e., it can be free standing) on desktop 13 in a vertical orientation, while the stepped arrangement of bottom wall 20 is hidden from view by the lower portions of side walls 16 and 18.

In order to enhance the structural integrity of organizer 10, a plurality of ribs 50 are formed on the outer surfaces of first and second rear closure panels 26 and 30. Ribs 50 are preferably vertically oriented. In addition, ribs 52 are formed on the outer bottom surfaces of second and third bottom panels 24 and 28, preferably in alignment with ribs 50.

In addition, to enhance the structural integrity of side walls 16 and 18, which perform much of the supporting function of organizer 10 when it is arranged vertically on a horizontal surface, horizontally oriented ribs 54 are preferably formed on the inner surfaces thereof that are exposed at the rear of organizer 10.

Figure 2:
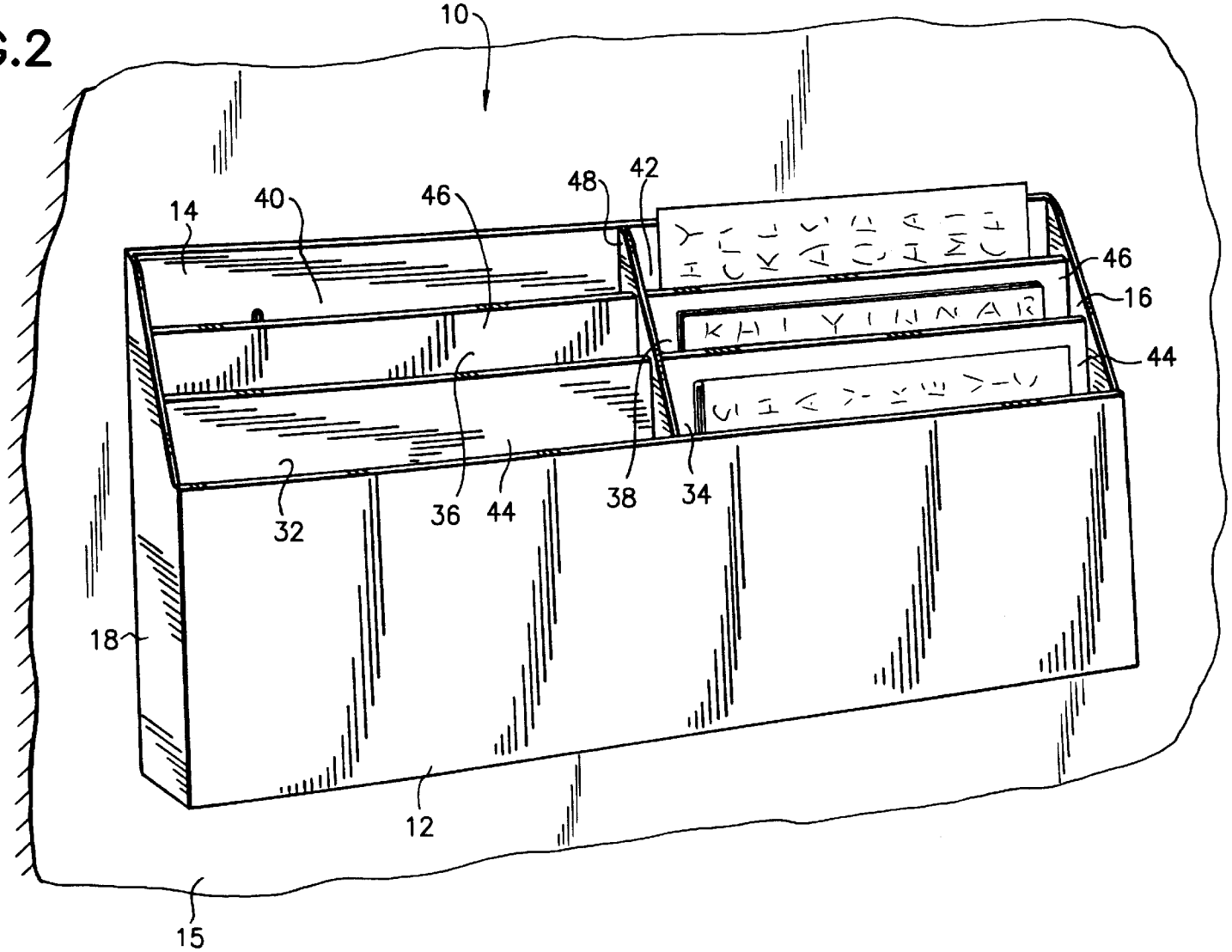
FIG. 2 is another perspective view thereof, showing the organizer hanging from the wall.
Figure 3:
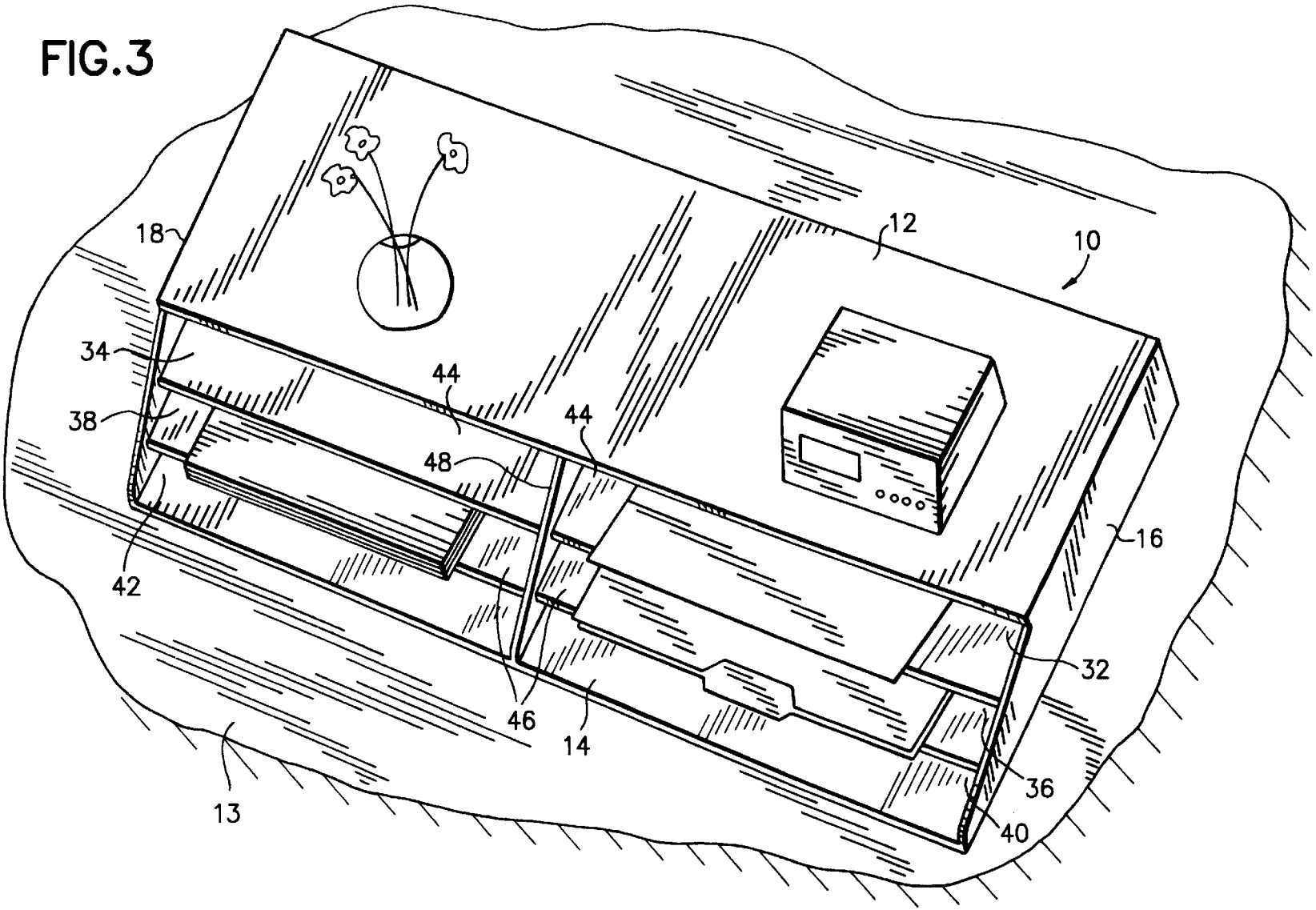
FIG. 3 is still another perspective view thereof, showing the organizer lying flat on a horizontal surface, such as a desk or table top, showing its use in the horizontal position.
Figure 4:
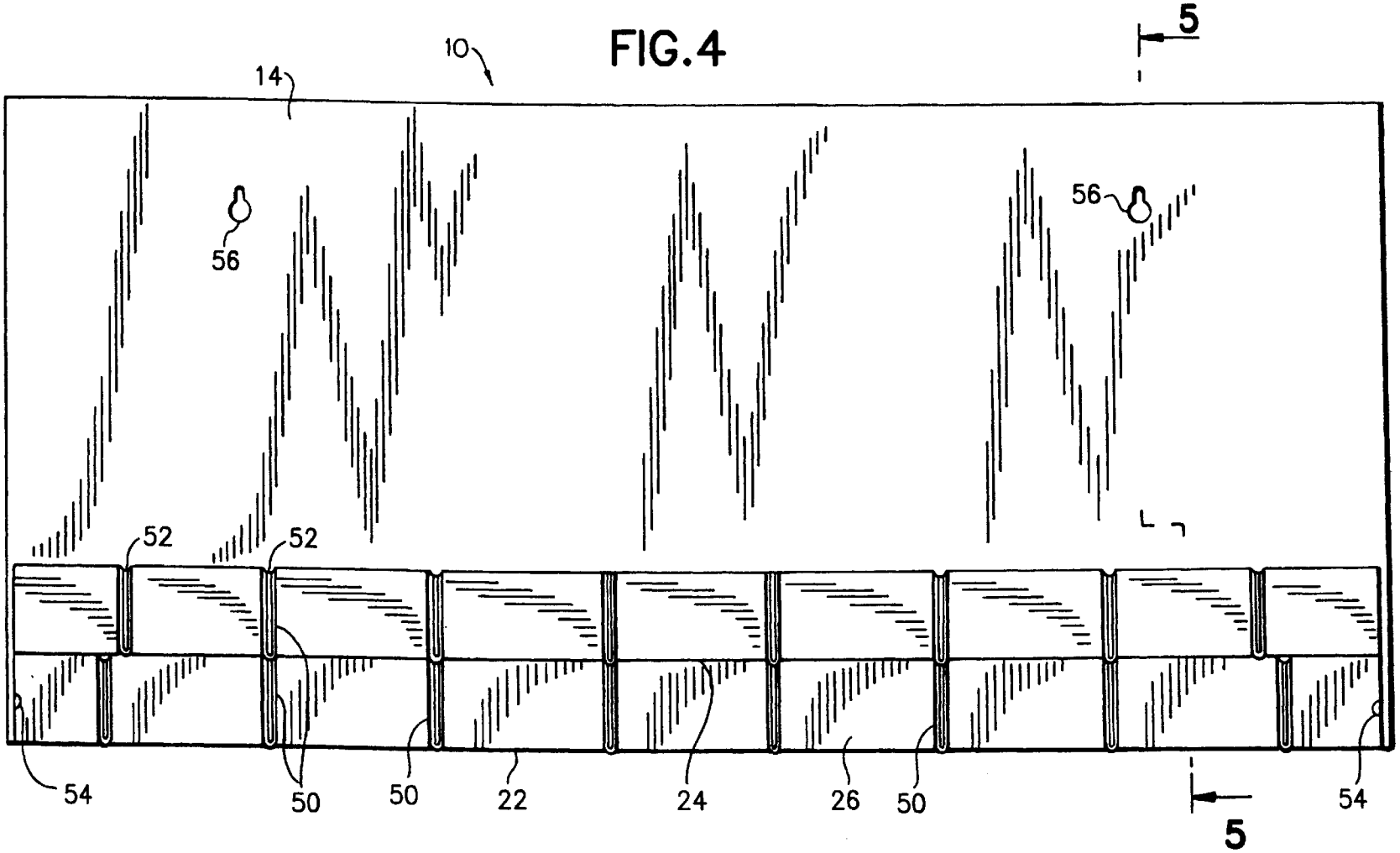
FIG. 4 is a rear elevational view thereof.

Of course, organizer 10 need not rest on desktop 13 in the vertical orientation of FIG. 1. Alternatively, organizer 10 can be hung on a wall 15, as shown in FIG. 2. In this regard, the upper end of rear wall 14 is provided with two holes or openings 56 (preferably keyhole shaped) on opposite sides thereof for receiving screws or nails 17 in a wall. Still further, organizer 10 can be oriented 90° from that shown in FIG. 1, such that rear wall 14 and the rear edges of side walls 16 and 18 support organizer 10 on desktop 13, as shown in FIG. 3. In such case, the file folders will be oriented horizontally, but will still be staggered for easy reading.

The organizer 10 of the present invention can be fabricated from a relatively simply two-piece mold, with only one cam action portion for forming the keyholes 17. The main portion of the mold defines the outer surface configuration of the organizer. The second portion of the mold has elongated tongue-like members which are inserted into the main portion of the mold and which define the spaces between the vertical members 44, 46 (see FIG. 5). However, during molding, and injection of the plastic material, the forces are very high and tend to cause the tongue-like members which form the spaces 32, 36, 40 in FIG. 5 will tend to be undesirably moved or dislodged. Therefore, the main portion of the mold includes openings therein, and the tongue portions form spaces 32, 36, 40 have projections thereon which engage the openings in the main portion of the mold, to stabilize the tongue-like portions to prevent movement thereof during the molding process. As a result, holes 58 are formed in the bottom panels. The holes 58 are the result of a stabilizing mechanism for the mold, but also result in a lighter product since less plastic is used. Moreover, since file folders or the like are intended to be stored in the organizer, there is no disadvantage to having holes 58 in the bottom panels thereof.

In the event that water or other liquid falls into any of the compartments 32–42, holes 58 are provided in bottom panels 22, 24 and 28, to permit drainage.

Accordingly, file folder organizer 10 provides a staggered relation to equal size file folders, while also being able to sit on desk 13. In this regard, the stepped arrangement for staggering is hidden from view by side walls 16 and 18, so as to provide a clean and neat appearance, and the side walls 16 and 18 also function to support file folder organizer 10.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A file folder organizer comprising:

a front wall extending in a lengthwise direction of the file folder organizer, and said front wall having a lower edge and an upper edge, said front wall having opposite side portions which are spaced apart in said lengthwise direction;

a rear wall extending in said lengthwise direction and having a lower edge and an upper edge, said rear wall having opposite side portions which are spaced apart in said lengthwise direction;

spaced apart side walls extending in a depthwise direction perpendicular to said lengthwise direction and integrally connected with respective opposite side portions of both of said front wall and said rear wall in order to connect said front wall and said rear wall together in parallel, spaced apart relation such that the lower edge of said rear wall is raised relative to the lower edge of said front wall and the upper edge of said rear wall is raised relative to the upper edge of said front wall, and lower edges of said side walls and the lower edges of said front wall are substantially coplanar so as to support said file folder organizer on a horizontal surface in a vertical orientation thereof, each said side wall being formed as a flat wall having a flat exterior surface without any flanges extending outwardly therefrom in a direction other than said depthwise direction;

a bottom wall integrally connecting the lower edge of said front wall to the lower edge of said rear wall, said bottom wall having a plurality of steps of different heights, said steps being parallel and offset from each other in a heightwise direction of said organizer and in a depthwise direction of said organizer, said bottom wall being at least partially enclosed by and integrally connected to said side walls so that said side walls hide said steps of said bottom wall;

at least one dividing wall for dividing an area bounded by said front wall, said rear wall and said side walls into a plurality of compartments, at least two of said compartments being closed at a bottom thereof by different steps of said bottom wall so as to provide a staggered relation to said compartments, said at least one dividing wall being integrally connected to said side walls, said at least one dividing wall including at least one lengthwise wall parallel to said front and rear walls and positioned therebetween, and each said dividing wall having a first section that connects together adjacent steps and a second section integrally formed with said first section, said second section of each said dividing wall extending from said first section of a same dividing wall to a height much greater than a height of a rearwardmost step connected therewith, with the height of each second section being much greater than a height of said first section and such that an upper edge of each dividing wall is adjacent upper edges of said spaced apart side walls, and each said dividing wall extending for an entire length of each respective compartment;

said side walls, said front wall, said at least one dividing wall and said rear wall all extending upward from said bottom wall by a substantially large distance so as to create deep compartments for storage of file folders therein; and wherein said file folder organizer is an integral, unitary, one-piece molded construction.

2. A file folder organizer according to claim 1, wherein said at least one dividing wall further includes at least one transverse wall perpendicular to said at least one lengthwise wall and extending between said at least one lengthwise wall and at least one of said front wall and said rear wall.

3. A file folder organizer according to claim 1, further including a plurality of strengthening ribs on said bottom wall.

4. A file folder organizer according to claim 3, further including at least one rib on strengthening each said side wall.

5. A file folder organizer according to claim 1, further including at least one rib on strengthening each said side wall.

6. A file folder organizer according to claim 1, further including a plurality of holes in said bottom wall for receiving and stabilizing a mold portion during molding of the file folder organizer.

* * * * *